US010066894B1

(12) United States Patent
Kempf et al.

(10) Patent No.: US 10,066,894 B1
(45) Date of Patent: Sep. 4, 2018

(54) SILENT SAFETY FOR A CROSSBOW

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 15/626,207

(22) Filed: Jun. 19, 2017

(51) Int. Cl.
*F41B 5/12* (2006.01)
*F41B 5/14* (2006.01)

(52) U.S. Cl.
CPC ..... *F41B 5/12* (2013.01); *F41B 5/123* (2013.01); *F41B 5/1469* (2013.01)

(58) Field of Classification Search
CPC ..... F41B 5/12
See application file for complete search history.

(56) References Cited

U.S. PATENT DOCUMENTS

| | | | |
|---|---|---|---|
| 5,884,614 | A | 3/1999 | Darlington et al. |
| 6,205,990 | B1 | 3/2001 | Adkins |
| 6,736,123 | B1 | 5/2004 | Summers et al. |
| 7,814,894 | B2 | 10/2010 | Giroux |
| 9,097,485 | B2 | 8/2015 | Lipowski |
| 9,255,754 | B1 | 2/2016 | Kempf |

*Primary Examiner* — John Ricci
(74) *Attorney, Agent, or Firm* — Donald J. Ersler

(57) ABSTRACT

An improved crossbow lock mechanism assembly includes a trigger housing, a seer lever, a seer lock lever, a latch, trigger, a spring, a detent ball, and a safety slide bar having one ball detent. Selectively positioning the safety slide bar in a safe position, the spring forces the detent ball into a safety detent notch, which holds the safety bar in safety position, thus preventing movement of the seer lever. Selectively positioning the safety slide bar in a fire position results in the spring creating friction between the ball and safety bar, thus holding safety bar in place and allowing movement of the seer lever. A second embodiment uses a pivoting safety lock lever. The engagement of the seer lever with the string latch is indirect, because of a roller pin spaced therebetween. A third embodiment includes a safety slide bar, which makes indirect contact with the seer lever.

12 Claims, 8 Drawing Sheets

SILENT SAFETY FOR A CROSSBOW

BACKGROUND OF THE INVENTION

1. Field of the Invention

The present invention relates generally to archery and more specifically to a silent safety for a crossbow, which creates virtually no audible sound when the safety is moved from a "safe" position to a "fire" position. Game animals do not hear the silent safety for a crossbow, when the movement of the safety is shifted from a "safe" position to a "fire" position.

2. Discussion of the Prior Art

U.S. Pat. No. 5,884,614 to Darlington et al. discloses a crossbow with improved trigger mechanism. U.S. Pat. No. 6,205,990 discloses a dry-fire prevention mechanism for crossbows. U.S. Pat. No. 6,736,123 to Summers et al. discloses a crossbow trigger. U.S. Pat. No. 7,814,984 to Giroux discloses a anti dry-fire device for crossbows. U.S. Pat. No. 9,255,754 to Kempf discloses a crossbow lock mechanism. U.S. Pat. No. 9,255,754 is hereby incorporated into this application by reference in its entirety. It appears that the prior art does not teach or suggest a silent safety for a crossbow, which makes virtually no noise when shifted from a "safe" position to a "fire" position.

Accordingly, there is a clearly felt need in the art for a silent safety for a crossbow, which makes virtually no noise when shifted from a "safe" position to a "fire" position and includes on one detent notch.

SUMMARY OF THE INVENTION

The present invention provides a silent safety for a crossbow, which makes virtually no noise when shifted from a "safe" position to a "fire" position. A crossbow includes a riser, a barrel, two bow limbs, two cams, a bow string, a trigger housing and a stock. The stock is attached to one end of the barrel. The riser is attached to the barrel in front of the stock. The bow limbs extend from opposing ends of the riser. Each bow limb is terminated with one of the two cams. The bow string is retained on the two cams. The trigger housing is contained within the stock or the barrel.

The silent safety for a crossbow includes the trigger housing, a seer lever, a seer lock lever, a string latch, a safety, and a trigger. A mechanism cavity is formed in the trigger housing to receive and retain the seer lever, the seer lock lever and the string latch. The seer lever includes a seer base, an anti-dryfiring projection, a latch projection, and an elongated pivot link. The anti-dryfiring projection extends from one end of the seer base and the elongated pivot link extends from an opposing end of the seer base. The latch projection extends outward from a length of the seer base. One end of the elongated pivot link is pivotally retained in the mechanism cavity. An opposing end of the elongated pivot link is pivotally engaged with the trigger.

The trigger includes a trigger lever and a trigger link. An end of the trigger lever is pivotally retained on the barrel. One end of the trigger link is pivotally retained on the trigger lever, adjacent the trigger lever pivot point. The other end of the trigger link is pivotally retained on an opposing end of the pivot link. The string latch includes a latch base, an arrow shaft yoke, a seer notch and a spring projection. The arrow shaft yoke extends from one side of the latch base and the spring projection extends from an opposing side of the latch base at one end thereof. The seer notch is formed in an opposing end of the latch base. The string latch is pivotally retained in the mechanism cavity adjacent the spring projection. The seer notch engages the latch projection.

The seer lock lever includes a latch finger and an impact finger. The latch finger extends from one end of the seer lock lever and the impact finger extends from an opposing end of the seer lock lever. The latch finger is sized to capture the anti-dryfiring projection. A seer lever stop extends outward from the mechanism cavity, above the seer base and between the anti-dry firing projection and the latch projection to stop excessive upward motion of the seer lever. A latch ball stop is preferably retained between the impact finger and the seer lever stop, but may have other suitable locations. A safety bar is slideably located to engage with the seer lever, so that when the safety bar is in a safe position, the safety bar does not interfere with the movement of the seer lever, and when the safety bar is in a fire position, the seer lever is constrained from movement. A second embodiment uses a pivoting safety lock lever. The engagement of the seer lever with the string latch is indirect, because of a roller pin spaced therebetween. A third embodiment includes a safety slide bar, which makes indirect contact with the seer lever.

In use, as the safety slide bar is moved from a safe position to a fire position, a spring loaded ball is received by a detent notch, which may create an audible sound. As the safety bar is moved from the safe position to a fire position, the spring loaded ball is forced into a spring pocket, compressing the spring, thus increasing pressure from the ball to the safety bar, however there will be virtually no audible sound when the safety bar reaches the fire position, as there is no movement of the spring loaded ball in the spring pocket.

Accordingly, it is an object of the present invention to provide a silent safety for a crossbow, which creates virtually no audible sound when the safety is moved from a safe position to a fire position, as to not alert game animals from hearing the movement of the safety as the hunter prepares to fire the crossbow.

These and additional objects, advantages, features and benefits of the present invention will become apparent from the following specification.

DETAILED DESCRIPTION OF THE PREFERRED EMBODIMENTS

Figure 1:
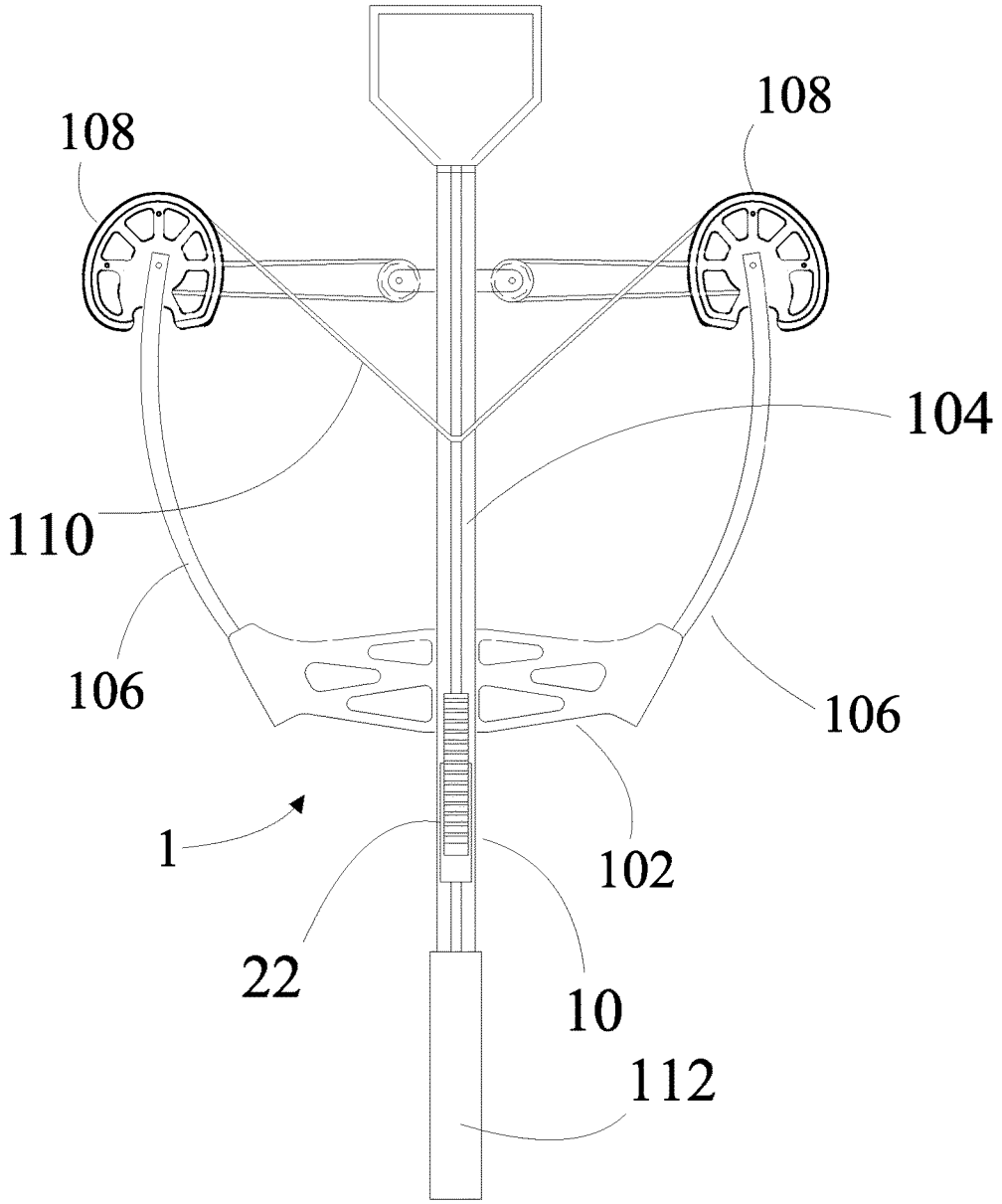
FIG. 1 is a top view of a crossbow including a silent safety in accordance with the present invention.
Figure 2:
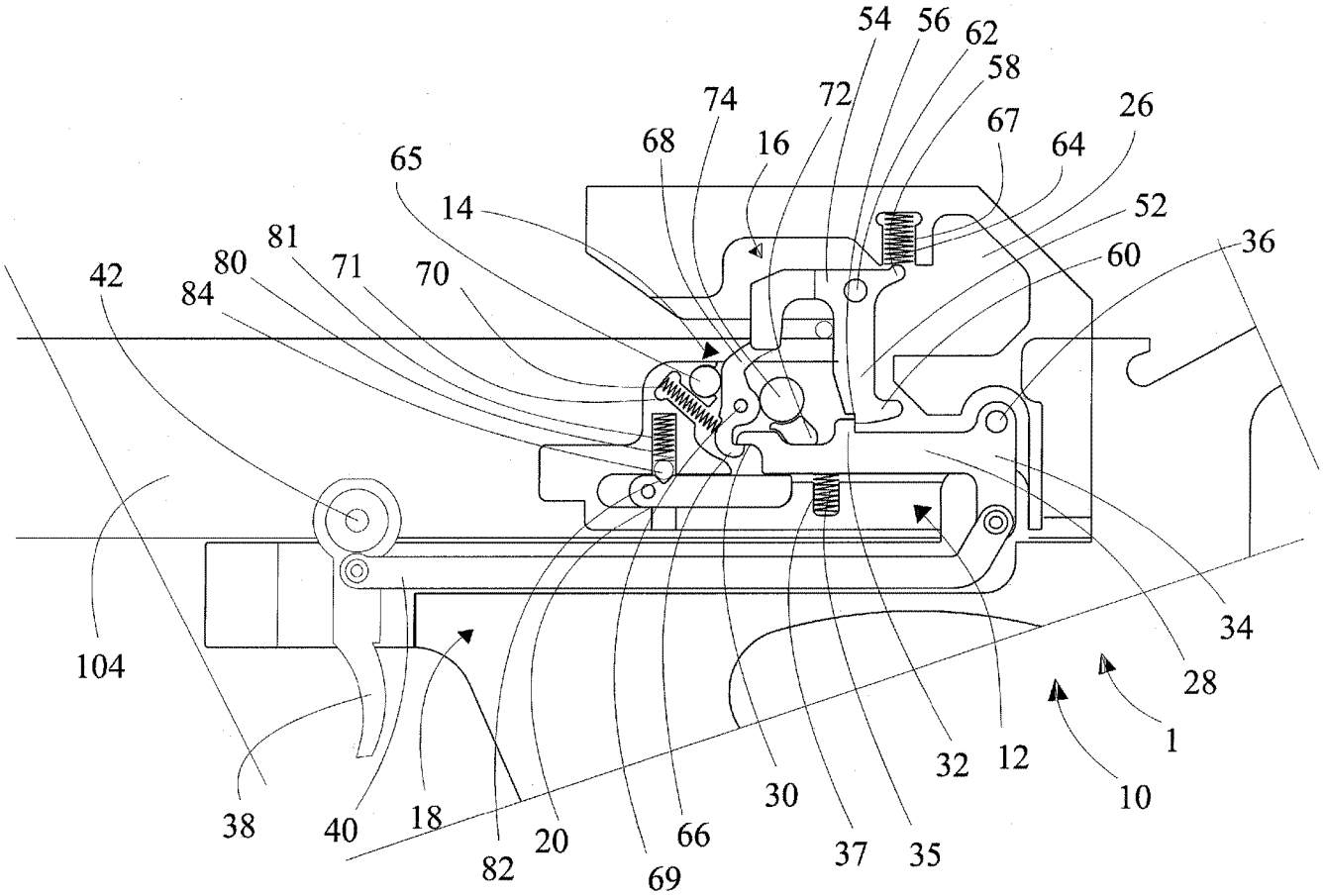
FIG. 2 is a side view of a silent safety for a crossbow with a cover removed for illustrating a safety slide bar in a safe position in accordance with the present invention.

With reference now to the drawings, and particularly to FIGS. 1-2, there is shown a top view of a crossbow 100 including a silent safety 1. The crossbow 100 includes a riser 102, a barrel 104, two bow limbs 106, two cams 108, a bow string 110, a stock 112 and a trigger housing 10. The two bow limbs 106 extend from opposing ends of the riser 102. The stock 112 extends from one end of the barrel 104. The riser 102 is attached to the barrel 104 in front of the stock 112. Each bow limb 106 is terminated with one of the two cams 108. The bow string 110 is retained on the two cams 108. The trigger housing 10 is contained within the stock 112. The silent safety 1 is located in the trigger housing 10.

Figure 3:
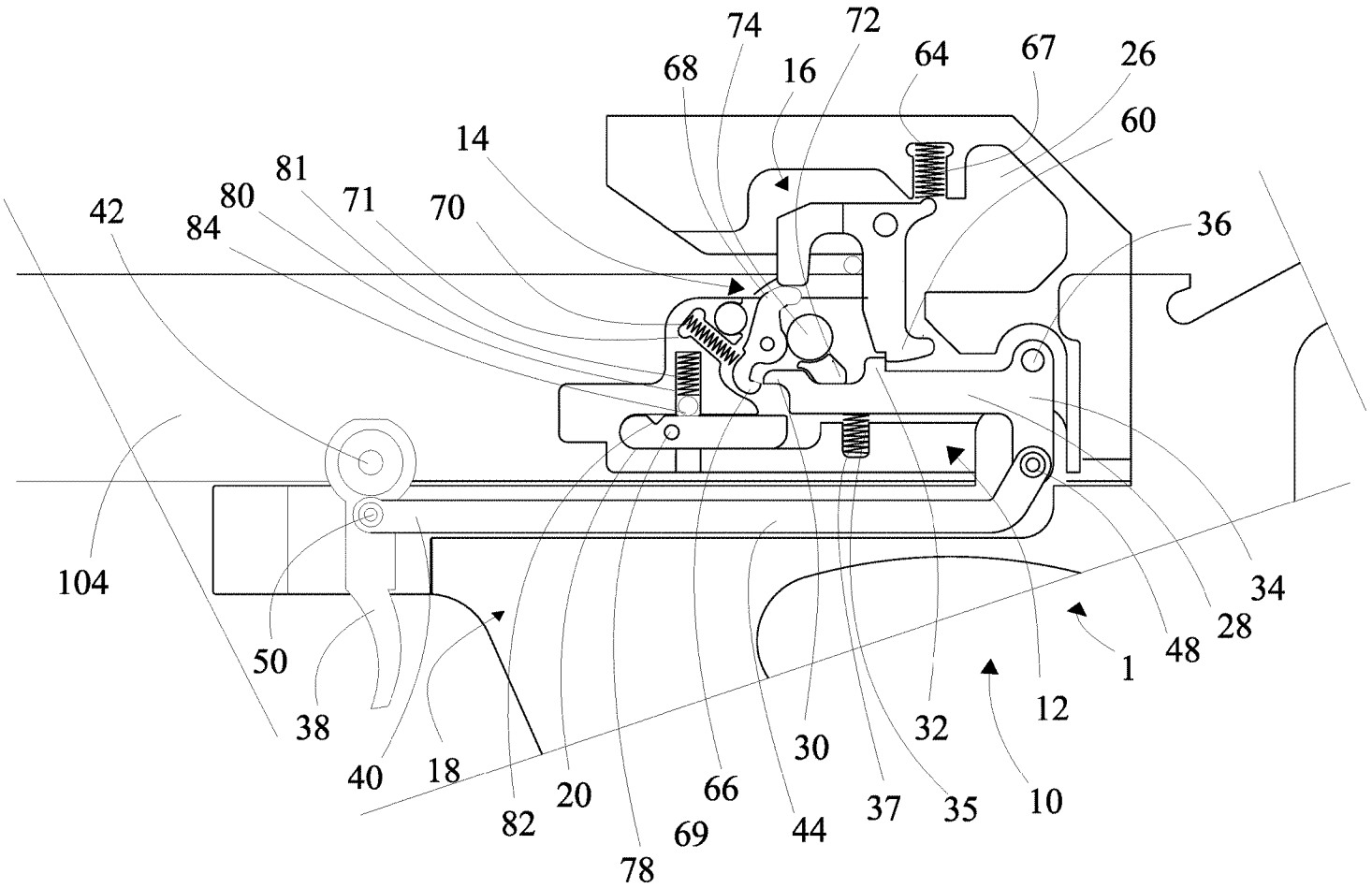
FIG. 3 is a side view of a silent safety for a crossbow with a cover removed for illustrating a silent safety in a fire position in accordance with the present invention.

With reference to FIGS. 2-3, the improved crossbow lock mechanism 1 preferably includes the trigger housing 10, a seer lever 12, a seer lock lever 14, a string latch 16, a trigger 18 and a safety slide bar 20. A mechanism cavity 26 is formed in the trigger housing 10 to receive and retain the seer lever 12, the seer lock lever 14, the string latch 16 and the safety slide bar 20. The seer lever 12 includes a seer base 28, an anti-dryfiring projection 30, a latch projection 32, and an elongated pivot link 34. The anti-dryfiring projection 30 extends from one end of the seer base 28 and the elongated pivot link 34 extends from an opposing end of the seer base 28, substantially perpendicular to the seer base 28. The latch projection 32 extends outward from a length of the seer base 28. One end of the pivot link 34 is pivotally retained in the mechanism cavity 26 with a seer pivot pin 36.

A seer compression spring 35 is retained in a seer spring cavity 37. The seer compression spring 35 biases the seer lever 12 toward the string latch 16. The trigger 18 includes a trigger lever 38 and a trigger link 40. An end of the trigger lever 38 is pivotally retained on the barrel 104 with a fastener 42 or the like. The trigger link 40 includes an elongated body 44 and an end leg 46. The end leg 46 preferably extends outward from one end of the elongated body 44 at an obtuse angle. An opposing end of the elongated pivot link 34 is pivotally retained by an end of the end leg 46 with a pivot pin 48. An opposing end of the trigger link 44 is pivotally retained on the trigger lever 38, adjacent the fastener 42 with a pivot pin 50.

The string latch 16 includes a latch base 52, an arrow shaft yoke 54, a seer notch 56, a spring projection 58 and a latch foot 60. A notch may be defined as a cavity. The string latch 16 retains the string 110 in a safety latch position and releases the string 110 in a fire latch position. The arrow shaft yoke 54 extends from one side of the latch base 52 and the spring projection 58 extends from an opposing side of the latch base 52 at one end thereof. The seer notch 56 is formed on the one side of the latch base 52 and the latch foot 60 is formed on the opposing side of the latch base 52 at an opposing end thereof. The one end of the latch base 52 is pivotally retained in the mechanism cavity 26 with a pivot pin 62, adjacent the spring projection 58. A latch spring 64 is retained in a latch spring cavity 67. The latch spring 64 contacts the spring projection 58 and biases the latch foot 60 to contact the latch projection 32.

The seer lock lever 14 includes a latch finger 66 and an impact finger 68. The seer lock lever 14 is retained in the mechanism cavity 26 with a pivot pin 69. The latch finger 66 extends from one end of the seer lock lever 14 and the impact finger 68 extends from an opposing end of the seer lock lever 14. The latch finger 66 is sized to capture the anti-dryfiring projection 30. A seer lock lever ball stop 65 is preferably located behind the impact finger 68, but may have other suitable locations. The seer lock lever ball stop 65 is preferably fabricated from a rubber material, but other resilient materials may also be used. The seer lock lever ball stop 65 provides an impact cushion for the impact finger 68. Insertion of an arrow into the crossbow 100 causes the latch finger 66 of the seer lock lever 14 to pivot and release the anti-dryfiring projection 30 of the seer lever 12. A lock spring 70 is retained in a lock spring cavity 71. The lock spring 70 biases the latch finger 66 toward the anti-dryfiring projection 30.

A seer lever stop 72 extends outward from the mechanism cavity 26 in the trigger housing 10, above the seer base 28 and between the anti-dry firing projection 30 and the latch projection 32 to stop excessive upward motion of the seer lever 12. A latch ball stop 74 is preferably retained between the seer lock lever 14 and the seer lever stop 72, but may have other suitable locations. The latch ball stop 74 is preferably fabricated from a rubber material, but other resilient materials may also be used. The latch ball stop 74 provides an impact cushion for the seer lock lever 14 and the string latch 16.

The safety slide bar 20 includes a slide pin 78 and a position lock spring 80. A safety detent notch 82 is formed in a top of the safety slide bar 20. A detent ball 84 engages the safe detent notch 82, and is biased toward the safety bar 20 with the position lock spring 80. The position lock spring 80 is retained in a position lock cavity 81. The slide pin 78 is pressed through the safety slide bar 20 to be shuttled between a safe position and a fire position. The safety slide bar 20 is maintained in the safe position by the position lock spring 80 forcing the detent ball 84 into the safe detent notch 82. The safety slide bar 20 is maintained in the fire position, through friction, by the position lock spring 80 forcing the detent ball 84 on to the upper surface of the safety slide bar 20. When the safety slide bar 20 is moved from the fire position to the safety position, the position lock spring 80 decompresses, and forces the detent ball 84 into the safe detent notch 82, generally creating an audible noise. When the safety bar 20 is moved from the safe position to the fire position, the detent ball 84 is forced upwards, and compresses the lock spring 80 within the position lock cavity 81. This added pressure derived from further compressing the lock spring 80 provides adequate friction between the detent ball 84 and the upper surface of the safety bar 20 to hold the safety slide bar 20 in the fire position, without making an audible sound.

Figure 4:
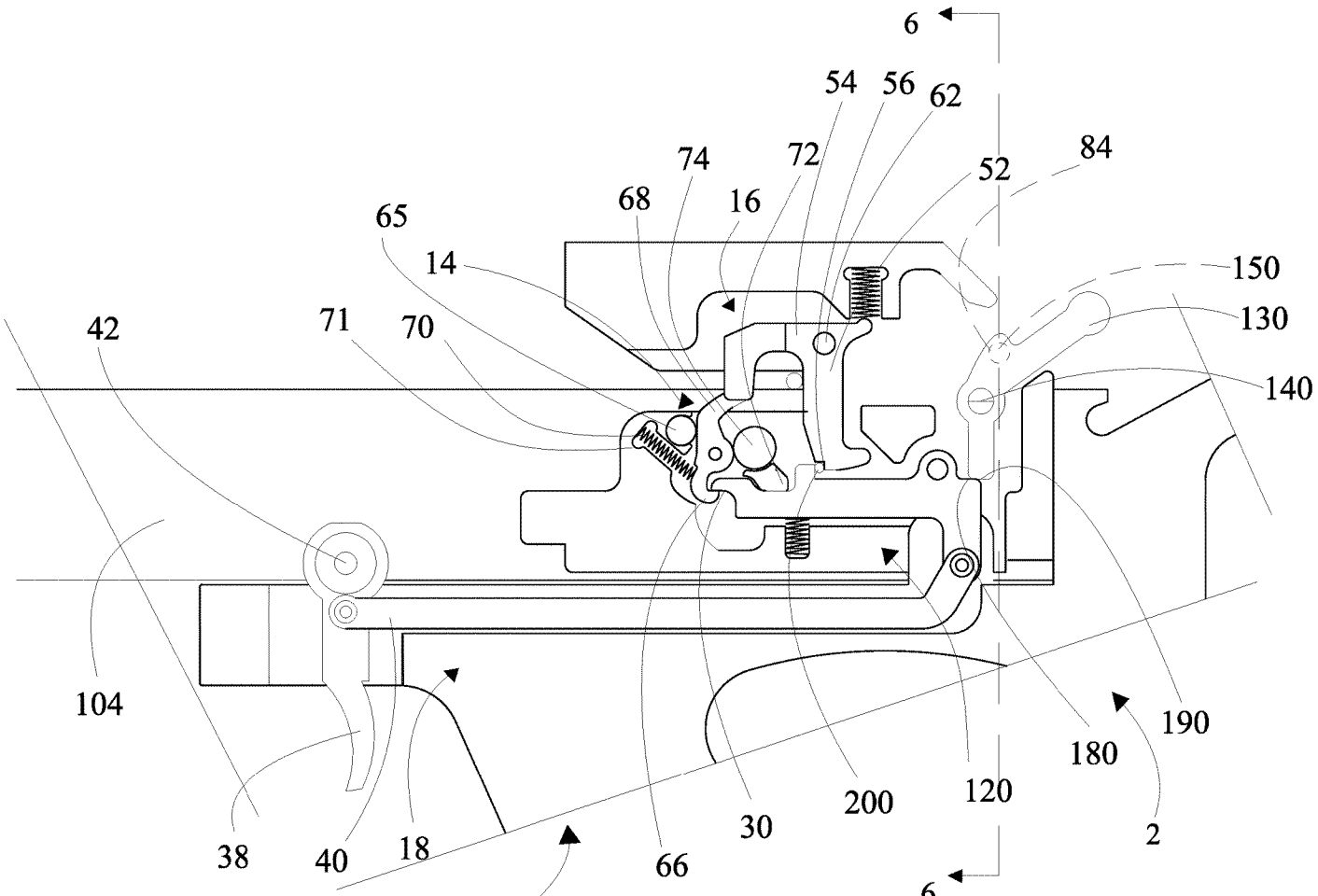
FIG. 4 is a side view of a second embodiment of a silent safety for a crossbow with a cover removed for illustrating the safety slide bar in a safe position in accordance with the present invention.
Figure 5:
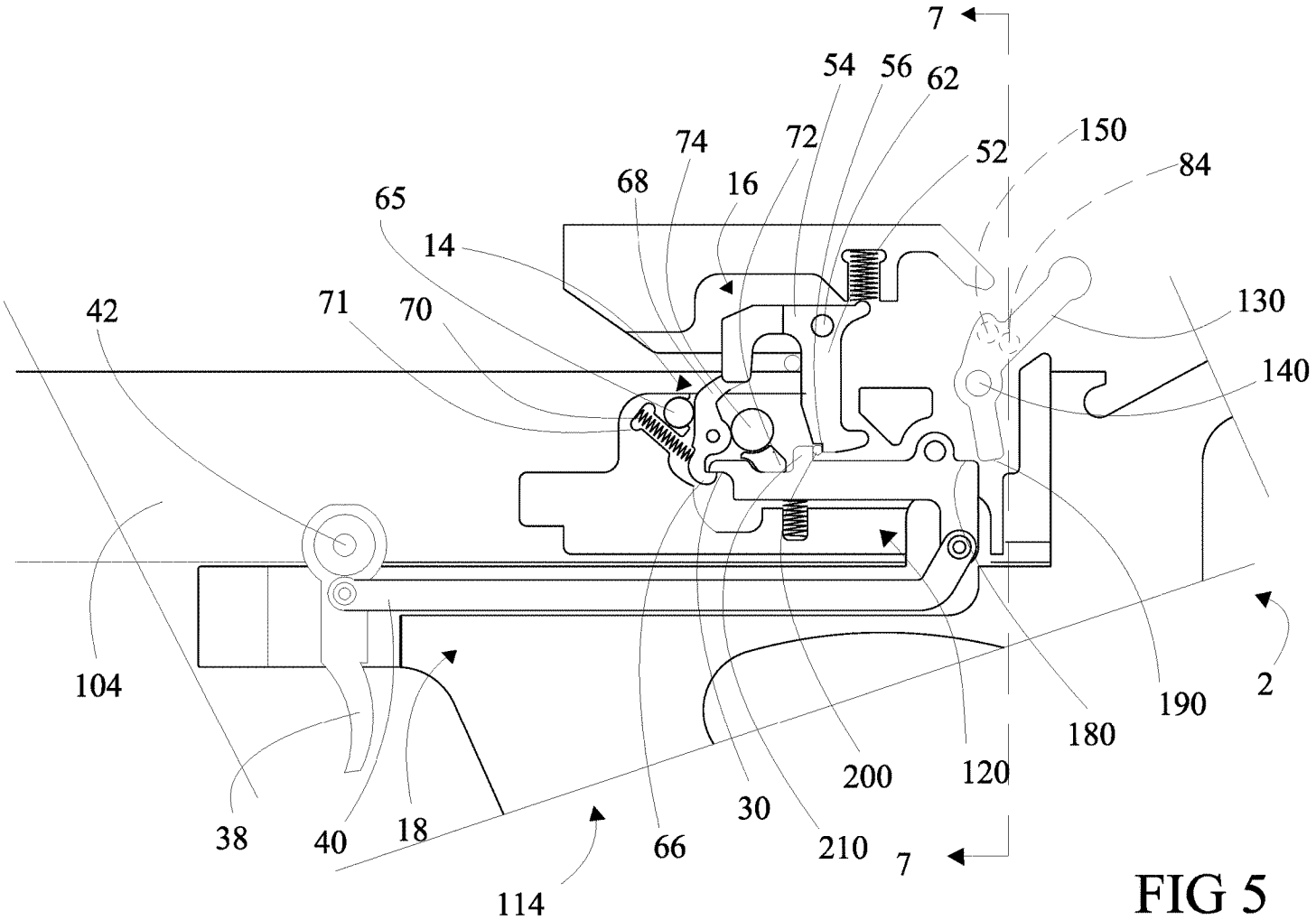
FIG. 5 is a side view of a second embodiment of a silent safety for a crossbow with a cover removed for illustrating the safety slide bar in a fire position in accordance with the present invention.
Figure 7:
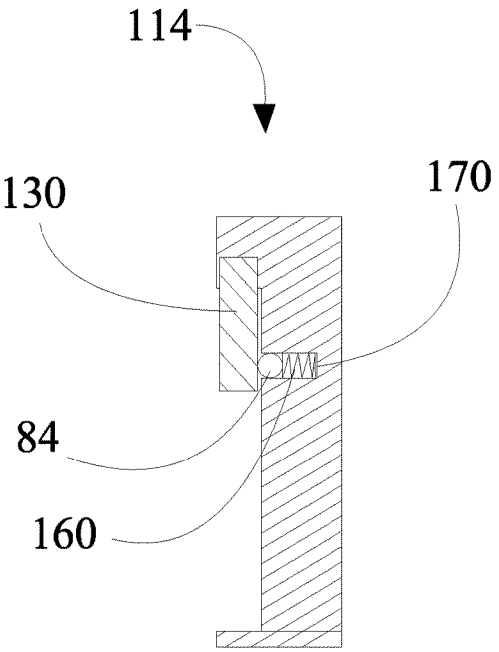
FIG. 7 is a cross sectional view of FIG. 5, cut through a silent safety lever of a second embodiment of a silent safety for a crossbow in accordance with the present invention.
Figure 6:
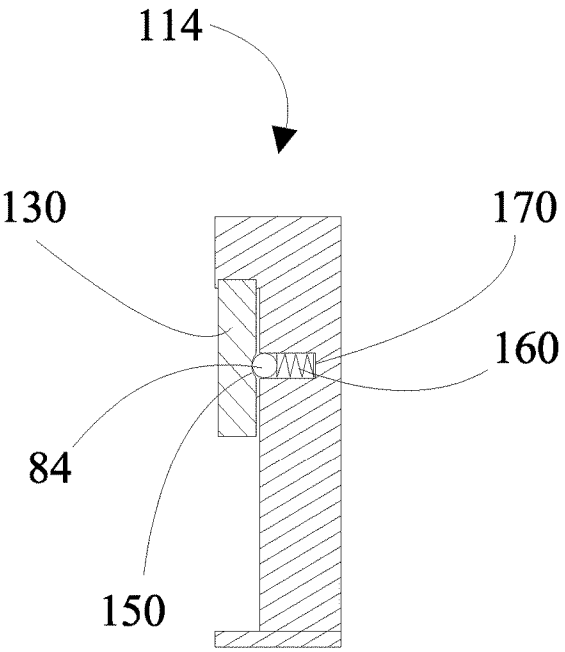
FIG. 6 is a cross sectional view of FIG. 4, cut through a silent safety lever of a second embodiment of a silent safety for a crossbow in accordance with the present invention.

With reference to FIGS. 4-5, a second embodiment of a silent safety 2 preferably includes a trigger housing 114, a seer lever 120, the seer lock lever 14, the string latch 16, the trigger 18 and a safety lock lever 130. The safety lock lever 130 is pivotally engaged with the trigger housing 114 through a pivot pin 140. A detent cavity 150 is formed in a backside of the safety lock lever 130. The detent ball 84 is retained in a spring hole 170. The detent ball 84 is biased outward from the spring hole 170 with a compression spring 160. A seer safety leg 190 extends from the safety lock lever 130. The seer safety leg 190 makes contact with a seer surface 180 to keep the seer lever 120 in a lock position. A roller pin 200 is rotatably retained in the trigger housing 114. The roller pin 200 is located between the seer notch 56 of the string latch 16 and a latch projection 210 of the seer lever 120. The string latch 16 is indirectly in contact with the seer lever 120 through the roller pin 200. The detent ball 84 is located in the detent cavity 150 in a safe position. The detent ball 84 is located against a backside of the safety lock lever 130 in a fire position. The seer safety leg 190 is not in contact with the seer lock surface 180 in a fire position.

Figure 8:
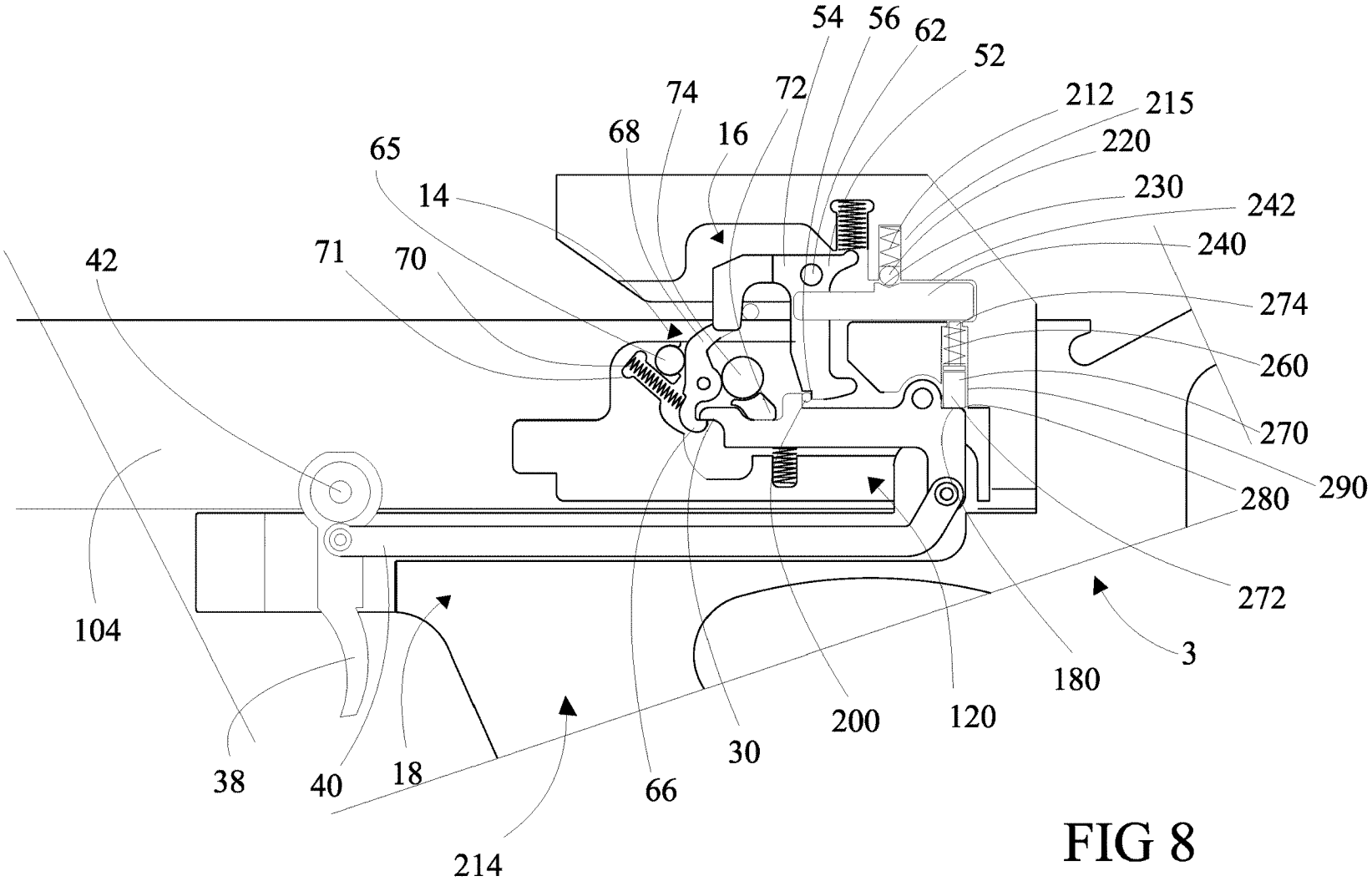
FIG. 8 is a side view of a third embodiment of a silent safety for a crossbow with a cover removed for illustrating the safety slide bar in a safe position in accordance with the present invention.
Figure 9:
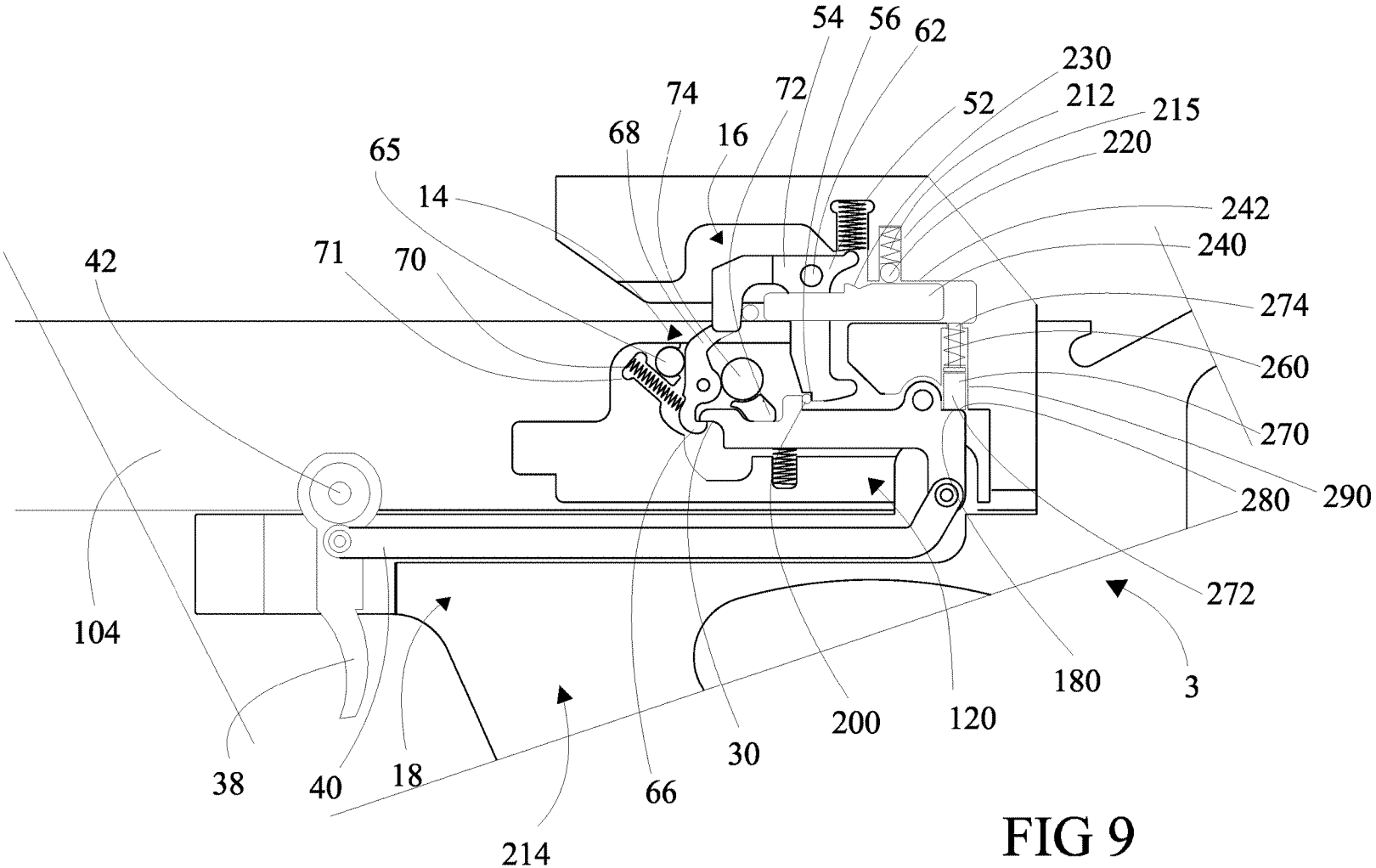
FIG. 9 is a side view of a third embodiment of a silent safety for a crossbow with a cover removed for illustrating the safety slide bar in a fire position in accordance with the present invention.

With reference to FIGS. 8-9, a third embodiment of a silent safety 3 preferably includes a trigger housing 214, the seer lever 120, the seer lock lever 14, the string latch 16, the trigger 18 and a safety slide bar 240. The safety slide bar 240 is slidably engaged with the trigger housing 214 in a safety slot 242. A detent cavity 230 is preferably formed in a top of the safety slide bar 240. A detent ball 220 is retained in a detent hole 215. The detent ball 84 is biased outward from the detent hole 215 with a compression spring 212. A piston counterbore 290 is formed in the trigger housing 214 to receive a safety lock piston 270. The safety lock piston 270 includes a piston base portion 272 and a piston safety portion 274, which extends from the base portion 272. A bottom 280 of the safety base portion 272 makes contact with a top piston surface 180 of the seer lever 120. A top of the piston safety portion 274 makes contact with a bottom of the safety slide bar 240, when the safety slide bar 240 is in a lock position. A piston compression spring 260 is retained on the piston safety portion 274 to bias the safety lock piston 270 downward against the seer lever 120. The safety slide bar 240 is indirectly in contact with the seer lever 120 through the safety lock piston 270. The string latch 16 is indirectly in contact with the seer lever 120 through the roller pin 200. The detent ball 84 is located in the detent cavity 230 in a safe position. The detent ball 84 is located against a top of the safety slide bar 240 in a fire position. A top of the piston safety portion 274 does not make contact with a bottom of the safety slide bar 240, when the safety slide bar 240 is in a fire position.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A silent safety for a crossbow comprising:

a string latch is capable of holding a string;

a seer lever is engaged with said string latch for preventing a release of the string from said string latch, said seer lever is not engaged with said string latch to allow a release of the string from said string latch; and a safety device includes a detent cavity, said safety device does not include a second detent cavity, said safety device is retained in a safe position by a biased object engaged in said detent cavity, said safety device is in contact with said seer lever in said safe position, said safety device is not in contact with said seer lever in a fire position, wherein said biased object is biased against said safety device in said fire position.

2. The silent safety for a crossbow of claim 1 wherein:

said engagement of said seer lever with said string latch is one of direct and indirect.

3. The silent safety for a crossbow of claim 1 wherein:

said engagement of said safety device with said seer lever is one of direct and indirect.

4. The silent safety for a crossbow of claim 1 wherein:

said biased object is a spring loaded detent ball.

5. The silent safety for a crossbow of claim 1, further comprising:

a seer lock lever is engaged with said seer lever in said safety position and is not engaged with said seer lever in a fire position.

6. The silent safety for a crossbow of claim 1, further comprising:

a lock spring for biasing a seer lock lever to engage a dry-firing projection of said seer lever.

7. A silent safety for a crossbow comprising:

a string latch is capable of holding a string;

a seer lever is engaged with said string latch for preventing a release of the string from said string latch, said seer lever is not engaged with said string latch to allow a release of the string from said string latch; and a safety device includes a detent cavity, said safety device does not include a second detent cavity, said safety device is retained in a safe position by a biased object engaged in said detent cavity, said safety device prevents the release of said string in said safe position, said safety device allows the release of said string in a fire position, wherein said biased object is biased against said safety device in said fire position.

8. The silent safety for a crossbow of claim 7 wherein:

said engagement of said seer lever with said string latch is one of direct and indirect.

9. The silent safety for a crossbow of claim 7 wherein:

said engagement of said safety device with said seer lever is one of direct and indirect.

10. The silent safety for a crossbow of claim 7 wherein:

said biased object is a spring loaded detent ball.

11. The silent safety for a crossbow of claim 7, further comprising:

a seer lock lever is engaged with said seer lever in said safety position and is not engaged with said seer lever in a fire position.

12. The silent safety for a crossbow of claim 7, further comprising:

a lock spring for biasing a seer lock lever to engage a dry-firing projection of said seer lever.

* * * * *